US009027250B2

(12) United States Patent
Greer

(10) Patent No.: US 9,027,250 B2
(45) Date of Patent: May 12, 2015

(54) PROTECTIVE RISER GUIDE FOR SCISSORS

(71) Applicant: Jerry Randall Greer, Cookeville, TN (US)

(72) Inventor: Jerry Randall Greer, Cookeville, TN (US)

( * ) Notice: Subject to any disclaimer, the term of this patent is extended or adjusted under 35 U.S.C. 154(b) by 0 days.

(21) Appl. No.: 14/306,134

(22) Filed: Jun. 16, 2014

(65) Prior Publication Data

US 2014/0317939 A1 Oct. 30, 2014

Related U.S. Application Data

(63) Continuation-in-part of application No. 13/353,127, filed on Jan. 18, 2012, now Pat. No. 8,887,400.

(51) Int. Cl.

| | |
|---|---|
| ***A45D 29/02*** | (2006.01) |
| ***A45D 29/18*** | (2006.01) |
| ***B26B 29/04*** | (2006.01) |
| ***B26B 13/06*** | (2006.01) |

(52) U.S. Cl.
CPC ..... *B26B 29/04* (2013.01); *B26B 13/06* (2013.01)

(58) Field of Classification Search
CPC ..... A45D 29/00; A45D 29/18; A45D 29/02; B26B 29/04; B26B 13/06; B26B 13/24; B26B 13/10
USPC ..... 30/27, 233, 229, 260, 230, 178; 132/73.6, 73.5; 29/401.1; D8/57
See application file for complete search history.

(56) References Cited

U.S. PATENT DOCUMENTS

| | | | | | |
|---|---|---|---|---|---|
| 1,806,486 | A | * | 5/1931 | Mirafuentes | 30/233.5 |
| 2,682,108 | A | * | 6/1954 | Shaler | 30/230 |
| 2,688,186 | A | * | 9/1954 | Kraepelin | 30/233 |
| 2,701,415 | A | * | 2/1955 | Carney | 30/230 |
| 3,791,013 | A | * | 2/1974 | Rogers | 30/254 |
| 3,987,542 | A | * | 10/1976 | Visco | 30/233 |
| 4,850,110 | A | * | 7/1989 | Meier, Jr. | 30/135 |
| D398,210 | S | * | 9/1998 | Tanaka | D8/57 |
| 6,038,772 | A | * | 3/2000 | Cornell et al. | 30/233 |
| 2013/0327348 | A1 | * | 12/2013 | Ashur | 132/73.6 |

FOREIGN PATENT DOCUMENTS

RU 2167049 5/2001

OTHER PUBLICATIONS

Search Report from PCT/US2014/043296 (PCT Counterpart of instant application).

* cited by examiner

*Primary Examiner* — Ghassem Alie
(74) *Attorney, Agent, or Firm* — Shane V. Cortesi

(57) ABSTRACT

A protective riser guide for scissors is provided in the present disclosure. In certain embodiments, the protective riser guide is integrally formed with an arm of a pair of scissors. In other embodiments, the protective riser guide is removably attached to the exterior surface of a scissor arm. Preferably, the protective riser guide is in the shape of an arc extending away from the interior surface of the arm if the guide is integrally formed with the arm, or from the exterior surface if the guide is removably attached to the exterior surface. Due to the shape and position of the protective riser guide on the arm of a pair of scissors in certain embodiments, the protective riser guide is ergonomic and increases the safety of the operator of the scissors without interfering with the operator's cutting techniques.

20 Claims, 5 Drawing Sheets

PROTECTIVE RISER GUIDE FOR SCISSORS

RELATED APPLICATION

This application is a continuation-in-part of U.S. patent application Ser. No. 13/353,127, filed Jan. 18, 2012, the contents of which are incorporated herein by reference in their entirety.

FIELD OF INVENTION

The present invention relates to the general field of safety devices for scissors. It is specifically related to a safety guide for scissors where the scissor's operator's fingers and hands are in close and hazardous relationship with the scissor's sharp edges.

BACKGROUND OF INVENTION

The field of cutting hair renders a risk to professional barbers and beauticians due to the operation of scissors that cut with sharp edges within close proximity of their hands and fingers. In this field it is natural that distractions can occur at any time ranging from conversations to being in a rush due to schedules, etc. With distractions stylists may inherently cut their fingers while simply performing the normal job of cutting hair. This is due to a very typical technique of placing the fingers in close proximity of the cutting edges of the scissors. There are two basic avenues in which scissors enter into use. One is the purchase of new scissors and the other is the use of scissors that are already owned. Typically, existing scissors are the majority of the scissors in use.

However, prior art reveals that most safety enhancements are integrated as a part of the original blade or scissor arm designs without detachment or attachment capabilities and therefore do not address in-use scissors. The previous safety designs are mostly limited to a particular scissor arm configuration to allow very specific edge grinding and other manufacturing restrictions. For example regarding U.S. Pat. No. 6,305,088 to Novinger, et al., the feature is a scissor's cutting edge wherein the cutting edge is located below the leading portion of the scissor arm and the protrusion feature is a flat protruding portion forward of the cutting edge. There are several inherent restrictions created by the geometry of this cutting edge. With U.S. Pat. No. 5,964,038 to Devito emphasis is placed on new scissor arm designs with cutting edge portions and non-cutting edge portions as well as related geometry such as rounded tips for safety in cutting hair. Each individual professional has his own scissor arm design preferences as to the ratio of cutting and non-cutting portions allowing him to integrate his techniques with the particular scissor arm design he prefers. For U.S. Pat. No. 5,379,521 to Lynders requires that a flat and a U-shaped shield are attached to the outer surfaces of the opposing cutting scissor arms, however the related guarding shields the cutting edges in a manner that prevents close cutting techniques by professional barbers.

There are also a number of inventors that have tried to protect from scissor cuts by using finger or hand guards applied to the hand or finger. U.S. Pat. No. 6,665,874 B2 to Stolf presents a finger guard for protection. This may be somewhat of a frustration to many professionals and limit their dexterity. U.S. Pat. No. 5,991,918 also provides similar finger guarding that may limit hand motion. U.S. Pat. No. 7,055,177 B2 also shows finger and hand guards. All of these types of safety devices have disadvantages in eliminating injuries.

Therefore, injury to the hair professional is still a problem. The above references are just samples of attempts to solve this problem in a crowded field. Many times inventor's scissor designs place such a high level of safe guarding from the cutting edges that they basically render the tool not useable for many desired hair cutting techniques. From this it can be seen that there is still a need for scissors that can reduce or eliminate injuries while at the same time allow hair professional to trim hair unfettered by guards that hinder their developed techniques and talents.

SUMMARY

There is a need for a protective riser guide for scissors that can reduce or eliminate injuries while at the same time allow hair professional to trim hair unfettered by guards that hinder their developed techniques and talents. The protective riser guide for scissors supports safety and the basic need for the scissor arm and cutting edge design as desired by the professional. One of the objectives is to provide guarding for the professional's favorite scissors without restricting well used cutting techniques. This invention can be a retrofit for existing, in use, scissors as well as being presented and packaged with new scissors. In addition, the protective riser guide provides a smooth surface for fingers to actually guide the scissors for a straighter cut. This particular invention can address the enhancement of safety after a pair of scissors has been formulated and is in the hands of an individual. In certain embodiments, the protective riser guide is intended to help minimize injury to the user of a pair of scissors without interfering with needed cutting techniques for proper stylists and is completely removable to allow proper sharpening that is periodically required.

BRIEF DESCRIPTION OF THE DRAWINGS

These and other features, aspects, and advantages of the invention will become better understood with regard to the following description, appended claims, and accompanying drawings where:

in FIG. 6, the protective riser guide extends beyond the tip of the scissor arm.

DETAILED DESCRIPTION OF THE INVENTION

Figure 1:
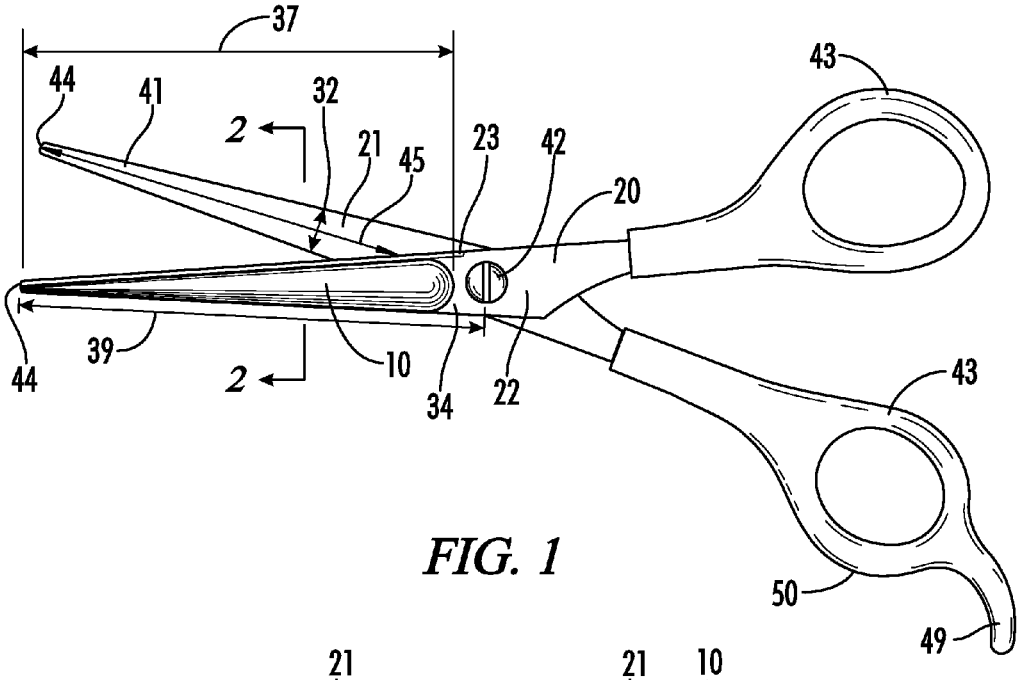
FIG. 1 is a front view of a combination of a protective riser guide and scissors of one embodiment of the present invention.

The present invention relates to the general field of safety devices for scissors, specifically safety devices for scissors wherein the scissor's operator's fingers and hands would be in a close and hazardous relationship with the scissor's sharp edges. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Overview:

There are two basic avenues in which scissors enter into use. One is the purchase of new scissors and the other avenue is the use of existing scissors that are already owned. Typically, existing scissors are the majority of the scissors in use. These scissors have already been designed, manufactured and have become favorites used by the professional for many years and in some cases passed down by others to the current users of the scissors. Since existing scissors are the majority of the scissors in use, one offering of the protective riser guide is the ability to attach to generic scissor designs and also detach from the generic scissor designs for reasons of maintenance, blade sharpening etc. The other offering of the protective riser guide is the ability to attach the protective riser guide during manufacture. A protective riser guide manufactured with the scissors provides potential for a more secure attachment than the addition of the protective riser guide attached to the existing scissors with bonding material. However, the protective riser guide allows for safety improvement with existing scissors as well as new scissors which are the two basic channels of use. During testing of the protective riser guide, injuries were greatly reduced allowing the professional to gain time efficiency by not worrying so much about injuries.

Examples of the protective riser guide 10 may include but are not limited to those depicted in FIGS. 3A, 3B, 3D, and 3E, which may be produced as a single part for attaching and removing with existing scissors. In addition, examples of the protective riser guide 10 manufactured with the production of new scissors may include but are not limited to those illustrated in FIGS. 3A through 3E. FIGS. 1 through 5 depict the protective riser guide 10 attached with scissors 20. One or both of the arms 21, 22 may include a protective riser guide 10, depending on the preferences of the operator. FIG. 2 section 2-2 is a cross sectional view showing the protective riser guide 10 section illustrating that the thickness and curvature of the protective riser guide 10 provide safety spacing between the hand or finger and the sharp scissor arm or blade. FIGS. 3A through 3E depict a sample of means for attaching the protective riser guide 10 to the scissor arm 21, 22. FIGS. 4A through 4E illustrate certain protective riser guide 10 features of some embodiments of the present disclosure, such as a tapered design and related radii 31 for a smooth surface, the ability to provide a generic fit to scissor arms 21,22, and a recessed area 13 permitting bonding material 11 or double back tape 12 to be captured in the recess 13 so that the protective riser guide may be attached to the scissor arm 21, 22. A slight curvature or radius 14 may allow a generic match to the curvature of existing scissor arms 21, 22.

Design Specifications:

FIG. 1 depicts the protective riser guide 10 included with generic scissors 20. The design specification of the protective riser guide 10 can be broken down into general areas that include scissors, shape, disposition, attachment, kits, methods of attaching, and methods of operating. However, these areas are very interrelated with each area dependent upon another area for the overall dynamics and synergy of the complete invention.

Scissors 20:

As known to those of ordinary skill, a pair of scissors 20 typically includes a pair of oppositely moveable scissor arms 21,22 pivotably connected to each other by a pivot 42. The scissor arms 21, 22 are each moveable M about the pivot 42 and each scissor arm 21, 22 comprises an arm proximal end forming a handle 43, an arm distal end forming an arm tip 44, an arm interior surface 41 distal to the pivot 42 and facing the other arm, an arm exterior surface 34 opposite the arm interior surface 41, arm interior and exterior surface lengths 45 and 39 extending from the pivot 42 to the arm distal end 44, arm interior and exterior surface widths 32 and 48 in the plane in which the arm 21, 22 is moveable about the pivot 42. Optionally, the widths of the interior and exterior surfaces 32 and 48 may vary along the length of the interior and exterior surfaces 45 and 39, as shown in FIG. 1. At least one arm 21, 22 includes a cutting edge 23. Optionally, the cutting edge 23 is angularly offset relative to the exterior surface 34, as best seen in FIGS. 2-3. Optionally, the pair of scissors 20 for use in the present invention is acceptable for cutting hair. If the pair of scissors 20 is acceptable for cutting hair, the handle 43 may include a finger rest 49 extending from a finger loop 50 as shown in FIG. 1. For purposes of the present invention, it will be understood that the cutting edge 23 refers to the edge of a scissor arm 21 or 22 at which the scissor arm meets the other scissor arm, as best seen in FIGS. 2-3. Thus, preferably, the protective riser guide 10 preferably is not present on this entire edge 23 at which the scissor arms 21, 22 meet, as shown in FIGS. 2-3. In other embodiments, the protective riser guide is only absent along the line 23A at which the scissor arms 21, 22 meet.

Unlike scissors known in the art, the scissors 20 further include at least one protective riser guide 10. In some embodiments, the at least one protective riser guide 10 is removably attached to the exterior surface 34 of one of the arms 21, 22. In other embodiments, the at least one protective riser guide 10 is integrally formed with one of the arms 21, 22.

The Shape of the Protective Riser Guide 10:

If the at least one protective riser guide 10 is integrally formed with an arm 21, 22, the protective riser guide 10 forms an arc 30 extending away from the interior surface 41 of the at least one arm 21, 22. Alternatively, if the protective riser guide 10 is removably attached to the exterior surface 34, the protective riser guide 10 forms an arc 30 extending from the exterior surface 34 of the arm 21, 22. The arc 30 has an arc width 33 substantially parallel to the interior surface width 32 or the exterior surface width 48 of the at least one arm 21, 22 depending on whether the guide 10 is integrally formed with the at least one arm 21, 22, and an arc height 31 that is substantially perpendicular to the width and length of the interior 41 or exterior surface 34 of the at least one arm 21, 22.

In some embodiments, the protective riser guide 10 is in the shape of a substantially semi-circular arc 30. In such embodiments, the diameter 33 of the substantially semi-circular arc 30 is substantially parallel to the interior surface width 32 or the exterior surface width 34, depending on whether the guide 10 is integrally formed with the at least one arm 21, 22.

Figure 4A:
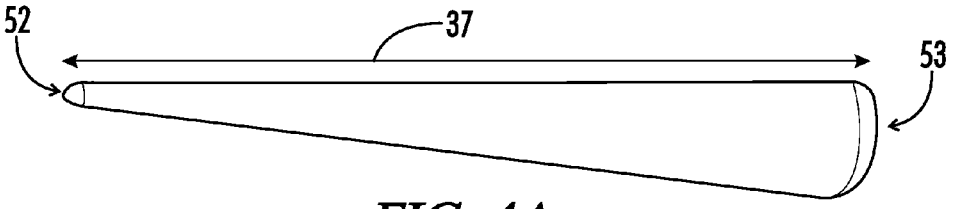
FIG. 4A is a front perspective view of one embodiment of a protective riser guide.

The protective riser guide 10 further includes a guide distal end 52, a guide proximal end 53 and a guide length 37 extending from the guide distal end 52 to the guide proximal end 53. Preferably, the guide distal end 52 is adjacent to the arm tip 44 and the guide proximal end 53 is adjacent to the pivot 42. In some embodiments, the protective riser guide 10 forms a substantially continuous arc 30 extending away from the interior surface 41, or if attached to the exterior surface 34, from the exterior surface 34 for a distance of at least about 2 inches along the guide length 37. In such an embodiment, the arc height 31 may or may not vary along the guide length 37. Optionally, if the protective riser guide 10 is attached to the exterior surface 34, the width 33 of the substantially continuous arc 30 does not exceed the width of the exterior surface 48 at any point along the exterior surface length 39. In addition, the substantially continuous arc 30 may comprise a tapered portion in which the width 33 of the substantially continuous arc 30 increases proximally along the guide length 37, as shown in FIGS. 1, 4A and 4E. For example, if the protective riser guide 10 is attached to the exterior surface 34, the substantially continuous arc 30 may comprise a tapered portion in which the width 33 of the substantially continuous arc 30 increases proximally along the exterior surface length 39.

Figure 4B:
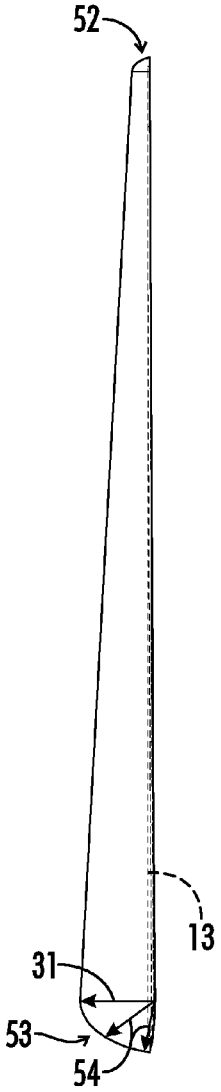
FIG. 4B is a right side view of one embodiment of the protective riser guide of FIG. 4A.
Figure 4C:
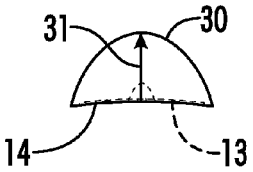
FIG. 4C is a top view of one embodiment of the protective riser guide of FIG. 4A.
Figure 4D:
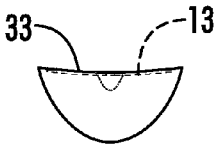
FIG. 4D is a bottom view of one embodiment of the protective riser guide of FIG. 4A.
Figure 4E:
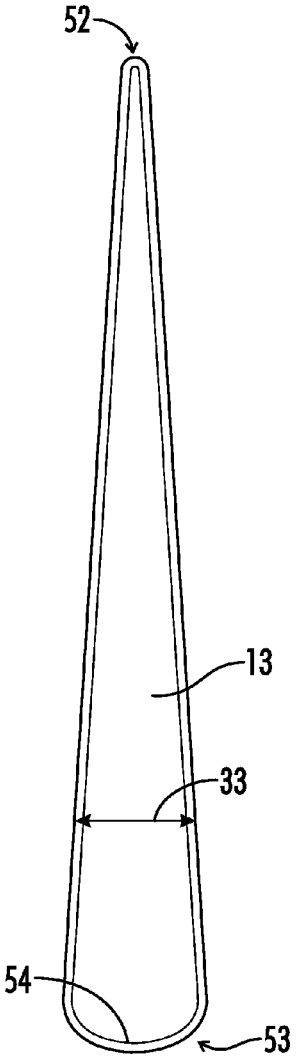
FIG. 4E is a rear view of one embodiment of the protective riser guide of FIG. 4A.
Figure 5:
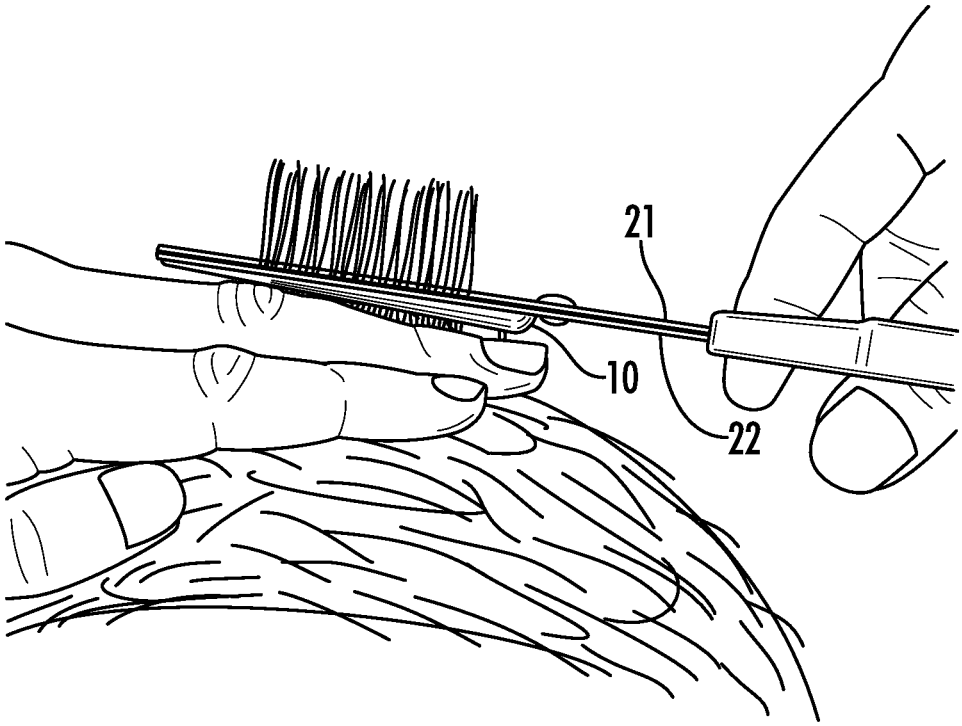
FIG. 5 is a perspective view of a use of an embodiment of a combination of a protective riser guide and scissors.

The protective riser guide 10 may further include a recess 13 for attaching the protective riser guide 10 to the exterior surface 34 of the at least one arm 21, 22, as shown in FIGS. 4B-4D, for example. The protective riser guide 10 may include a curvature 14 on the protective riser guide 10 surface opposite the smooth semicircular arc 30 surface that allows a match to the curvature of the exterior surface 34 of the scissors arms 21, 22, as shown in FIG. 4C.

Optionally, the protective riser guide 10 is comprised of plastic and/or a gel composition.

If the protective riser guide 10 is included in a kit for increasing the safety of a pair of existing scissors, the protective riser guide 10 may be configured to attach to the exterior surface 34 of a scissor arm 21, 22 and may further be configured such that when the guide length 37 is positioned on the exterior surface 34 parallel to the length of the exterior surface 39, the protective riser guide 10 forms a substantially semi-circular arc 30 extending from the exterior surface 34 for a distance of at least about 2 inches along the exterior surface length 39.

In some embodiments, the protective riser guide proximal end 53 is rounded as shown in FIGS. 1, 4A, 4B, 4E, and 5, for example. For example, the proximal end 53 may be rounded and include a proximal end radius 54, as shown in FIGS. 4B and 4E. Preferably, the guide 10 includes no sharp edges. Optionally, the guide distal end 52 is also rounded.

Figure 2A:
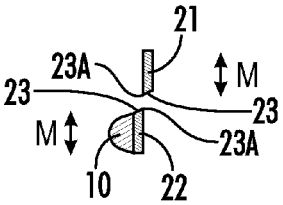
FIG. 2A is a sectional view taken along line 2-2 of FIG. 1 with an embodiment of one protective riser guide with one scissor arm.
Figure 2B:
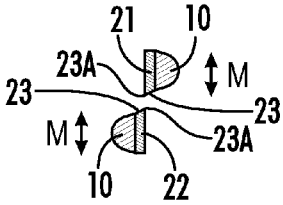
FIG. 2B is a sectional view taken along line 2-2 of FIG. 1 with an embodiment of a protective riser guide with each of the scissor arms.
Figure 2C:
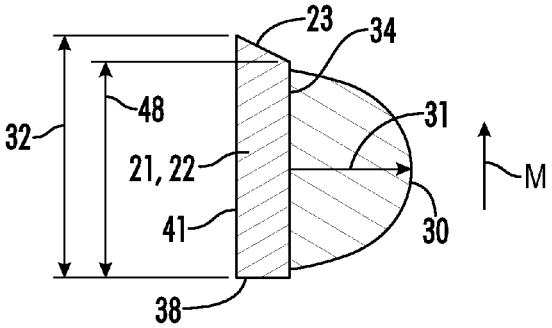
FIG. 2C is an enlarged view of FIG. 2A.

FIGS. 4A, 4B, 4C, 4D and 4E depict some of the features of the stand alone protective riser guide 10. These figures illustrate the tapered design and related radii 31 to allow for a smooth surface and provide a fit for generic scissor arms 21,22. FIGS. 2A, 2B, and 2C depict the cross section 2-2 showing the protective riser guide section attached or manufactured with one or both arms or arms 21, 22 illustrating that the thickness and curvature of the protective riser guide provide safety spacing between the hand or finger and the sharp scissor arm or blade. The shape and thickness guides the cutting edges 23 away from the professional's flesh and allow enough spacing between the scissor arm cutting edge 23 and the hand and fingers of the user for safety while at the same time the shape and size allow for the user to maneuver the scissors 20 in close contact with the person's head that is getting a haircut or hairstyle. The protective riser guide 10 also provides a smooth surface for fingers to actually guide the scissors 20 for a straighter cut. FIG. 4B shows a recessed area 13 in the protective riser guide 10 for bonding material 11 or double back tape 11 to be captured when using a bonding material or double back tape method 12, 11 for attaching the protective riser guide 10 to the scissor arm 21, 22. FIG. 4D shows a slight radius or curvature 14 that may be used to allow for a generic match of the protective riser guide 10 to the curvature of scissor arms 21, 22. Therefore the protective riser guide 10 includes advantages of being placed on any related arm or blade surface without regard to the arm geometry or the manufacturing procedures.

The protective riser guide 10 is mainly intended to help minimize injury to the user of the scissors 20 without interfering with desired or experienced cutting techniques of professional hair cutters. The protective riser guide 10 may be completely removable to allow proper sharpening that is periodically required. During testing of this feature, injuries were greatly reduced allowing the professional to gain time efficiency by not worrying so much about injuries. Because of the shape and design of the protective riser guide 10, it is retrofitable to existing in use scissors as well as being presented and packaged with new scissors. The protective riser guide 10 shape provide a means of acquiring a very good level of safety and at the same time allow users to maintain their scissor arm or blade preference.

Figure 6:
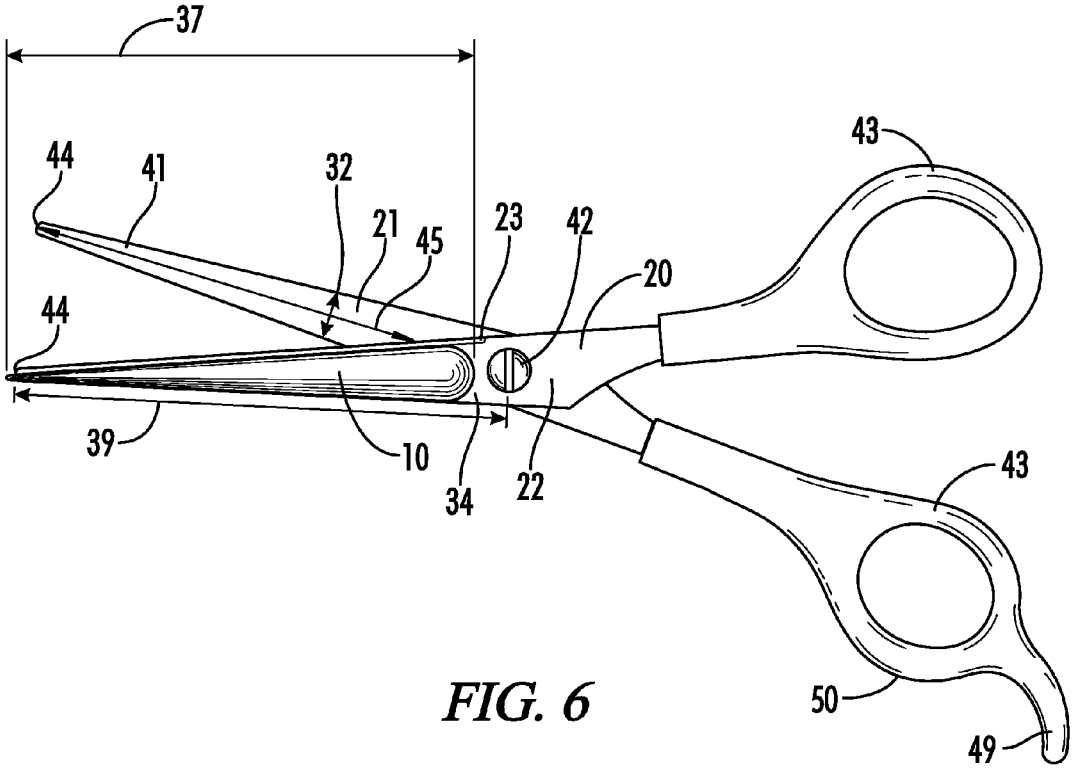
FIG. 6 is a front view of a combination of a protective riser guide and scissors of another embodiment of the present invention.

The Disposition of the Protective Riser Guide in Relation to the Scissors' Arm:

Another feature of the protective riser guide 10 is the disposition of the protective riser guide 10 on the scissors 20. The protective riser guide 10 is preferably disposed on the scissor arm 21, 22 on the exterior surface 34 (i.e., the opposite side or surface of the scissor arm 21, 22 from the interior surface 41). Optionally, both scissor arms 21, 22 may include a protective riser guide 10. For embodiments with only one protective riser guide 10, the protective riser guide 10 may be disposed such that the protective riser guide 10 is disposed on the exterior surface 34 of the scissor arm closest to the hand without the scissors 20. Thus the protective riser guide 10 will be between the flesh of the hand and the cutting edge 23 of the scissors 20. Preferably, the protective riser guide 10 is disposed on the scissor arm 21, 22 such that the protective riser guide 10 does not contact the cutting edge 23. This location of the protective riser guide 10 in relation to the cutting edge 23 guides the cutting edges 23 away from the professional's flesh thus helping to prevent injury while it also eliminates interference such as taught with prior art protrusions that cover the cutting area 23 or that are placed in front of the cutting edge 23 of the scissor arm 21, 22 in relation to the motion M of the scissor arm 21, 22 thus requiring the professional to modify or change his techniques for cutting. In other embodiments, the protective riser guide 10 extends beyond the arm tip 44, as shown in FIG. 6. In such embodiments, the distal end 52 of the protective riser guide 10 may beyond the arm tip 44 a distance of about ⅛ inch to about ½ inch (more preferably about ⅛ inch to about ¼ inch). The protective riser guide 10 is also disposed between the cutting edge 23 and the opposing end 38 of the exterior surface 34 of the scissor arm. The disposed location of the protective riser guide 10 may be adjusted up or down on the side of the exterior surface 34 to allow the user to place the protective riser guide 10 far enough from the cutting edge 23 and the opposing end 38 of the exterior surface 34 such that the protective riser guide 10 does not interfere with the desired cutting techniques of the professional yet still provide the desired safety for the hands and fingers. The protective riser guide 10 not only supports safety but it also supplies the needs of an arm or blade designed in conjunction with a safety guard that allows for the cutting techniques desired by the professional. With the protective riser guide 10 the professional is able to provide guarding for their hands and fingers while at the same time continue to use their favorite scissors. The professional will be able to do this without being restricted for well used cutting techniques.

Figure 3A:
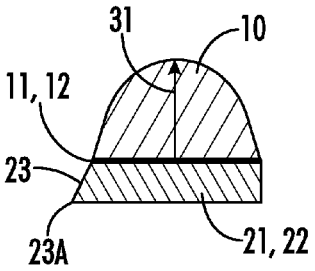
FIG. 3A is a sectional view of one embodiment of a combination of the protective riser guide and scissors depicting the attachment of the guide with the scissor arm.
Figure 3B:
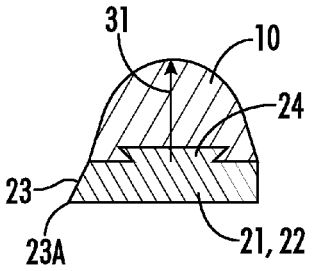
FIG. 3B is a sectional view of another embodiment of a combination of the protective riser guide and scissors depicting the attachment of the guide with the scissor arm.
Figure 3C:
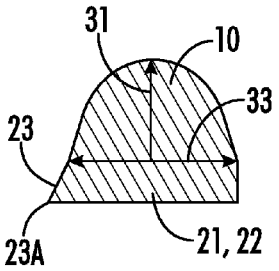
FIG. 3C is a sectional view of yet another embodiment of a combination of the protective riser guide and scissors depicting the guide with the scissor arm manufactured as one piece.
Figure 3D:
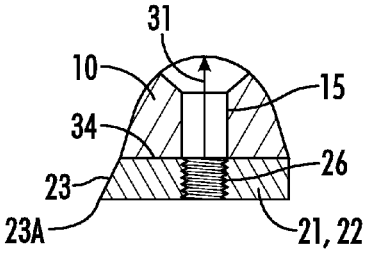
FIG. 3D is a sectional view of one embodiment of a combination of a protective riser guide and scissors depicting the attachment of the guide with the scissor arm.
Figure 3E:
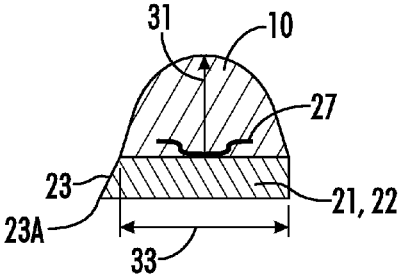
FIG. 3E is a sectional view of one embodiment of a combination of a protective riser guide and scissors depicting the attachment of the guide with the scissor arm.

The Attachment/Means of Attachment for a Protective Riser Guide and Scissors:

The protective riser guide 10 may be produced as a single part that may be attached and removed with existing scissors or the protective riser guide 10 may be manufactured with the production of new scissors. FIG. 1 depicts the protective riser guide 10 attached with generic scissors 20. A protective riser guide 10 may be attached to one or both arms of the scissors 20 if desired by the professional. For embodiments with only one protective riser guide 10, the protective riser guide 10 may be attached such that the protective riser guide 10 is attached on the exterior surface 34 of the scissor arm closest to the hand without the scissors 20. Thus the protective riser guide 10 will be between the flesh of the hand and the cutting edge 23 of the scissors 20. In certain embodiments, the protective riser guide 10 is removably attached to the exterior surface 34 of one of the arms 21, 22. In certain embodiments, the protective riser guide 10 is attached to the exterior surface 34 through a fastener, such as an adhesive, a screw, a locking pin or a clip. FIG. 3A shows the protective riser guide 10 and the scissor arm cross section 21, 22 with an attachment using a bonding material 12, or double back tape 11. The double backed type tape 11 may be removable or the bonding material 12 may be a hard bonding material as a more permanent type of attachment. FIG. 3B shows a dove tail 24 type of attachment for the protective riser guide 10 with the scissor arm 21, 22. FIG. 3C depicts the arm manufactured with the protective riser guide 10 shape as part of the scissor arm 21, 22. FIG. 3D illustrates a drilled and countersunk feature 15 that is mated with the use of a tapped threaded 26 attachment as a part of the arm 21, 22 design for attachment with the protective riser guide 10. FIG. 3E shows a clip design 27 to attach the protective riser guide 10 to the arm 21, 22. FIGS. 3B, 3D and 3E are attachments that are more substantial and allows for quicker attachment and detachment. The features of FIGS. 3B through 3E involve the new scissor market and the initial manufacture of the scissor for implementation of the protective riser guide 10 attachment. FIG. 3A depicts a solution for the protective riser guide 10 attachment for existing scissors 20 which could also be used in the new scissor market. The existing scissors market is estimated to be one of the areas with the greatest need for attachment of the protective riser guide 10. Therefore the protective riser guide 10 is able to attach for use with generic scissor designs and detach for reasons of maintenance, blade sharpening, etc. This allows safety improvement for both existing scissors as well as new scissors as these are the two basic channels of scissor use. With the type of attachment such as bonding and double back tape, the professional is able to be flexible and adjust the disposition and location of the protective riser guide 10 to provide the optimum for guarding their hands and fingers while at the same time continue to use their favorite scissors. The professional will be able to do this without being restricted from their well used cutting techniques. The protective riser guide 10 addresses the enhancement of safety when a pair of scissors is combined with the protective riser guide 10 and the guide is placed in the hands of a professional hair cutter. Due to the attachment means, the protective riser guide 10 is retrofit-able for existing in use scissors as well as being presented and packaged with new scissors. The protective riser guide 10 is mainly intended to help minimize injury to the user of a pair of scissors without interfering with needed cutting techniques for proper stylists and the protective riser guide 10 may be completely removable to allow proper sharpening that is periodically required. The protective riser guide 10 and its means of attachment include advantages such that it can be placed on any related arm surface without regard to the arm geometry or the manufacturing procedures. The protective riser guide 10 provides a means of acquiring a very good level of safety and still allows users to maintain their scissor arm preference.

The Method of Attaching:

In some embodiments, the present disclosure provides a method of increasing the safety of a pair of scissors 20 using the protective riser guides. Optionally, the method includes:

a) providing a pair of oppositely moveable scissor arms 21, 22 pivotably connected to each other by a pivot 42, the scissor arms 21, 22 each having an arm proximal end forming a handle 43, an arm distal end forming an arm tip 44, an arm interior surface 41 distal to the pivot 42 and facing the other arm 21, 22, an arm exterior surface 34 opposite the arm interior surface 41, an arm exterior surface length 39 extending from the pivot 42 to the arm distal end 44, and an arm exterior surface width 48 in a plane in which the arm 21, 22 is moveable about the pivot 42; and b) attaching to the exterior surface 34 of at least one of the arms 21, 22 a protective riser guide 10 such that the protective riser guide 10 forms an arc 30 extending from the exterior surface of the arm 34 on which the protective riser guide 10 is attached, the arc 30 having an arc width 33 substantially parallel to the exterior surface width 48 of the arm 21, 22 on which the protective riser guide 10 is attached and an arc height 31 substantially perpendicular to the width 48 and length 39 of the exterior surface 34 of the arm 21, 22 on which the protective riser guide 10 is attached.

The objectives and features of the invention provide for:

(a) A retrofit able feature to existing barber scissors for the purpose of safety.

(b) Places distance between the users fingers and the actual cutting edge.

(c) Easy attachment.

(d) Easy removable to allow maintenance such as periodic sharpening, etc.

(e) Newly designed scissors to be configured with mechanical attachments; such as by screws, pins, locking pins, clips, dove-tail attaching or even hard bonding if desired.

(f) Less weight with controlled size to be less intrusive.

(g) Elimination of interference with the establishment or design of cutting edge angles. Cutting edges can be optimized without the intrusion of an added feature. Guards are applied after the scissor arms are manufactured.

(h) Guide can also be positioned at the preference of the professional. The guard can be positioned forward to provide more protection at the arm tip.

(i) The guard can be applied to one arm only or both arms; this would be at the professional's discretion or preference.

g) The guard can be manufactured or molded at different sizes to accommodate a variety of scissor sizes.

(k) The guard can be molded by using a variety of plastics to vary the color, hardness, texture or other characteristics. Different guide colors can be available as desired by the professional.

ITEM LIST

Protective riser guide 10
Bonding material 11
Double back tape 12
Bonding recessed area 13
Slight radius for arm/curvature 14
Countersink 15
Scissors 20
Scissors arm $1^{st}$ 21
Scissors arm $2^{nd}$ 22
Cutting edge 23
Cutting edge line 23A
Dove tail attachment 24
Tapped/threaded 26
Clip design 27
Smooth semicir arc 30
Arc height/radii 31
Interior surface width 32
Arc width 33
Exterior surface 34
Guide length 37
Opposing end of ext. surface 38
Exterior surface length 39
Interior surface 41
Pivot 42
Handle 43
Arm tip 44
Interior surface length 45
Exterior surface width 48
Finger rest 49
Finger loop 50
Guide distal end 52
Guide proximal end 53
Proximal end radius 54

What is claimed is:

1. A pair of scissors comprising:

a pair of oppositely moveable scissor arms pivotably connected to each other by a pivot, the scissor arms each moveable about the pivot and each comprising an arm proximal end forming a handle, an arm distal end forming an arm tip, an arm interior surface distal to the pivot and facing the other arm, an arm exterior surface opposite the arm interior surface, an arm exterior surface length extending from the pivot to the arm distal end, and an arm exterior surface width in a plane in which the arm is moveable about the pivot, and a protective riser guide attached to the exterior surface of an arm, the protective riser guide having a proximal end adjacent to the pivot, a distal end, and a length extending from the proximal end to the distal end of the protective riser guide, the protective riser guide length substantially parallel to the arm exterior surface length of the arm on which the protective riser guide is attached, the protective riser guide forming a substantially semi-circular arc extending away from the exterior surface of the arm on which the protective riser guide is attached, the arc having a diameter substantially parallel to the exterior surface width of the arm on which the protective riser guide is attached and an arc height substantially perpendicular to the width and length of the exterior surface of the arm on which the protective riser guide is attached, wherein the arm on which the protective riser guide is attached further comprises a cutting edge, and further wherein the protective riser guide distal end extends distally beyond the arm tip of the arm on which the protective riser guide is attached.

2. The pair of scissors of claim 1, wherein the protective riser guide forms a substantially continuous, substantially semi-circular arc for at least about 2 inches along the length of the exterior surface, the substantially continuous, substantially semi-circular arc having a diameter substantially parallel to the exterior surface width of the arm on which the protective riser guide is attached and an arc height substantially perpendicular to the width and length of the exterior surface of the arm on which the protective riser guide is attached.

3. The pair of scissors of claim 2, wherein the substantially continuous, substantially semi-circular arc comprises a tapered portion in which the diameter of the substantially continuous, substantially semi-circular arc increases proximally along the exterior surface length.

4. The pair of scissors of claim 1, wherein the guide distal end is adjacent to the arm tip of the arm on which the protective riser guide is attached.

5. The pair of scissors of claim 1, wherein the protective riser guide does not contact the cutting edge.

6. The pair of scissors of claim 1, wherein the cutting edge is angularly disposed relative to the exterior surface of the arm on which the protective riser guide is attached.

7. The pair of scissors of claim 1, wherein a width of the substantially continuous arc does not exceed the width of the exterior surface of the arm on which the protective riser guide is attached at any point along the exterior surface length.

8. The pair of scissors of claim 1, wherein the distal end of the guide extends distally beyond the tip of the arm on which the protective riser guide is attached a distance of about 0.125 inches to about 0.5 inches.

9. The pair of scissors of claim 1, wherein the distal end of the guide extends distally beyond the tip of the arm on which the protective riser guide is attached a distance of about 0.125 inches to about 0.25 inches.

10. The pair of scissors of claim 1, wherein the guide distal end is rounded.

11. The pair of scissors of claim 1, wherein the guide proximal ended is rounded.

12. The pair of scissors of claim 1, wherein the protective riser guide is removably attached to the exterior surface by a fastener.

13. The pair of scissors of claim 12, wherein the fastener is selected from the group consisting of a reusable adhesive, a screw, a pin, a locking pin, and a clip.

14. The pair of scissors of claim 1, wherein the protective riser guide further comprises a recess for attaching the protective riser guide to the exterior surface.

15. The pair of scissors of claim 1, wherein the protective riser guide is located distal to the pivot.

16. A pair of scissors comprising:

a pair of oppositely moveable scissor arms pivotably connected to each other by a pivot, the scissor arms each moveable about the pivot and comprising an arm proximal end forming a handle, an arm distal end forming an arm tip, an arm interior surface distal to the pivot and facing the other arm, an arm exterior surface opposite the arm interior surface, an arm exterior surface length extending from the pivot to the arm distal end, and an arm exterior surface width in a plane in which the arm is moveable about the pivot; and a protective riser guide, the protective riser guide having a base removably attached to the exterior surface of a scissor arm, the protective riser guide forming an arc extending from the base to a peak, the peak opposite the base, wherein the peak is the furthest location along the arc from the exterior surface of the scissor arm on which the protective riser guide is removably attached, the protective riser guide and base each having a width substantially parallel to the exterior surface width of the scissor arm on which the protective riser guide is removably attached, the protective riser guide and peak each having a height substantially perpendicular to the width and length of the exterior surface of the scissor arm on which the protective riser guide is removably attached, the protective riser guide having a proximal end adjacent to the pivot, a distal end, and a length substantially parallel to the length of the exterior surface of the scissor arm on which the protective riser guide is removably attached, the guide length extending from the guide proximal end to the guide distal end, wherein the scissor arm on which the protective riser guide is removably attached further comprises a cutting edge, wherein the height of the peak and the width of the base gradually taper from the proximal end to the distal end, wherein the height of the protective riser guide gradually tapers on opposites sides of the peak from the peak to the base, and further wherein the protective riser guide distal end extends distally beyond the arm tip of the scissor arm on which the protective riser guide is removably attached.

17. The pair of scissors of claim 16, wherein the distal end of the guide extends distally beyond the tip of the scissor arm on which the protective riser guide is removably attached a distance of about 0.125 inches to about 0.5 inches.

18. The pair of scissors of claim 16 wherein the height of the protective riser guide gradually tapers symmetrically on opposites sides of the peak from the peak to the base.

19. The pair of scissors of claim 16, wherein the guide distal end and the guide proximal end are rounded.

20. The pair of scissors of claim 16 wherein the protective riser guide forms a symmetrical arc extending from the peak to the base.

* * * * *

UNITED STATES PATENT AND TRADEMARK OFFICE

CERTIFICATE OF CORRECTION

PATENT NO. : 9,027,250 B2
APPLICATION NO. : 14/306134
DATED : May 12, 2015
INVENTOR(S) : Jerry Randall Greer It is certified that error appears in the above-identified patent and that said Letters Patent is hereby corrected as shown below:

IN THE CLAIMS

Column 10, Line 33, in Claim 7, change “continuous” to -- semi-circular --

Signed and Sealed this
Sixth Day of October, 2015

Michelle K. Lee

Michelle K. Lee
*Director of the United States Patent and Trademark Office*